US010722747B2

(12) United States Patent
Campbell

(10) Patent No.: US 10,722,747 B2
(45) Date of Patent: Jul. 28, 2020

(54) EXERCISE RING

(71) Applicant: Ferrando Campbell, Dorchester, MA (US)

(72) Inventor: Ferrando Campbell, Dorchester, MA (US)

( * ) Notice: Subject to any disclaimer, the term of this patent is extended or adjusted under 35 U.S.C. 154(b) by 0 days.

(21) Appl. No.: 15/860,294

(22) Filed: Jan. 2, 2018

(65) Prior Publication Data

US 2018/0185697 A1 Jul. 5, 2018

Related U.S. Application Data

(60) Provisional application No. 62/441,402, filed on Jan. 1, 2017.

(51) Int. Cl.

| | |
|---|---|
| ***A63B 21/00*** | (2006.01) |
| ***A63B 21/002*** | (2006.01) |
| ***A63B 23/035*** | (2006.01) |
| ***A63B 21/28*** | (2006.01) |

(52) U.S. Cl.

CPC ..... *A63B 21/4035* (2015.10); *A63B 21/002* (2013.01); *A63B 21/00043* (2013.01); *A63B 21/00047* (2013.01); *A63B 21/00185* (2013.01); *A63B 23/03516* (2013.01); *A63B 21/28* (2013.01); *A63B 23/03508* (2013.01)

(58) Field of Classification Search

CPC ..... A63B 19/00; A63B 19/02; A63B 21/0004; A63B 21/00043; A63B 21/00047; A63B 21/00069; A63B 21/00072; A63B 21/00076; A63B 21/00185; A63B 21/002; A63B 21/0023; A63B 21/012; A63B 21/0125; A63B 21/015; A63B 21/018; A63B 21/065; A63B 21/068; A63B 21/15; A63B 21/151; A63B 21/159; A63B 21/28; A63B 21/285; A63B 21/4023; A63B 21/4027; A63B 21/4033; A63B 21/4035; A63B 21/4039; A63B 21/4041; A63B 21/4043; A63B 21/4045; A63B 23/035; A63B 23/03508; A63B 23/03516; A63B 23/12; A63B 23/1209; A63B 23/1245; A63B 23/1281; A63B 23/129; A63B 23/14; A63B 23/16; A63B 69/0057; A63B 69/0059; A63B 2209/00; A63B 2209/02; A63B 2209/023; A63B 2225/09; A63B 2225/093

See application file for complete search history.

(56) References Cited

U.S. PATENT DOCUMENTS 3,204,955 A * 9/1965 Quire ..... A63B 21/0004 482/91
4,560,160 A * 12/1985 Smith ..... A63B 21/018 482/120
4,632,391 A 12/1986 Orak
5,692,944 A 12/1997 Pellicone
(Continued)

*Primary Examiner* — Gary D Urbiel Goldner
(74) *Attorney, Agent, or Firm* — Boudwin Intellectual Property

(57) ABSTRACT

An exercise ring includes a ring comprising a flexible and inelastic material, and the ring includes a plurality of strands in a braid. A plurality of handles are disposed on opposing sides of the ring. The plurality of handles includes a cylindrical body having a first end, a second end, and a center portion, and the plurality of handles can provide an ergonomic gripping surface.

9 Claims, 3 Drawing Sheets

(56) References Cited

U.S. PATENT DOCUMENTS

| | | | | |
|---|---|---|---|---|
| D480,438 | S | 10/2003 | Walkow | |
| 7,037,240 | B2 | 5/2006 | Pemberton | |
| 7,785,240 | B2 | 8/2010 | Stugart | |
| 8,454,485 | B1 | 6/2013 | Hodes et al. | |
| 9,844,693 | B2 * | 12/2017 | Jones | A63B 21/065 |
| 2004/0014568 | A1 * | 1/2004 | Williams | A63B 7/04<br>482/37 |
| 2017/0050065 | A1 * | 2/2017 | Carter | A63B 21/1645 |
| 2018/0126205 | A1 * | 5/2018 | Rogers | F16B 2/065 |

* cited by examiner

EXERCISE RING

CROSS REFERENCE TO RELATED APPLICATIONS

This application claims the benefit of U.S. Provisional Application No. 62/441,402 filed on Jan. 1, 2017. The above identified patent application is herein incorporated by reference in its entirety to provide continuity of disclosure.

BACKGROUND OF THE INVENTION

The present invention relates to exercise equipment. Specifically, the present invention relates to an inelastic exercise ring having a plurality of handles thereon.

Many people desire to exercise various muscle groups while improving overall function and flexibility. Without the ability to target multiple muscles and muscle groups, people may have under developed muscles, poor joint strength and function, and poor coordination. Additionally, those who do not exercise have an increased risk of injury, disease, and conditions associated with a sedentary lifestyle. Devices in the known art include elastic resistance bands that provide users with the ability to perform a limited number of workouts. Therefore, a device that allows users to perform numerous exercises through fitness training involving controlled movements driven by the user is needed.

In light of the devices disclosed in the known art, it is submitted that the present invention substantially diverges in design elements from the known art and consequently it is clear that there is a need in the art for an improvement to existing exercise equipment. In this regard, the instant invention substantially fulfills these needs.

SUMMARY OF THE INVENTION

In view of the foregoing disadvantages inherent in the known types of exercise equipment now present in the prior art, the present invention provides an exercise ring wherein the same can be utilized for providing convenience for the user when performing a variety of exercising targeting specific muscle groups.

The present system comprises a ring comprising a flexible, inelastic material, wherein a plurality of handles are disposed on opposing sides of the ring. The plurality of handles comprise a cylindrical body having a first end, a second end, and a center portion, wherein the plurality of handles are configured to provide a gripping surface. In some embodiments, the plurality of handles are slidably engaged with the ring. In another embodiment, the plurality of handles are disposed equiangularly about the ring. In other embodiments, the first end and the second end have a larger diameter than the cylindrical body. In yet another embodiment, the center portion comprises a diameter greater than that of the cylindrical body. In some embodiments, the diameter of the center portion tapers towards the first end and the second end. In another embodiment, the plurality of handles comprise a pliable material. In other embodiments, the ring comprises a braided material. In yet another embodiment, the plurality of handles comprise a material having a coefficient of friction greater than one.

A method of using an exercise ring comprises providing a continuous closed ring of a flexible and inelastic material, wherein a plurality of handles are disposed on opposing sides of the ring, gripping at least one of the plurality of handles, removably securing the ring to a support, pulling away from the support to generate resistance, holding the resistance for a desired amount of time, and repeating the pulling and holding steps for a desired number of repetitions. In some embodiments, the support comprises a second user gripping at least one of the plurality of handles on the opposing side of the ring. In another embodiment, the method further comprises alternating the repetitions of the pulling and holding steps between a first user and the second user. In other embodiments, the support comprises a vertical support member inserted into a center of the ring.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
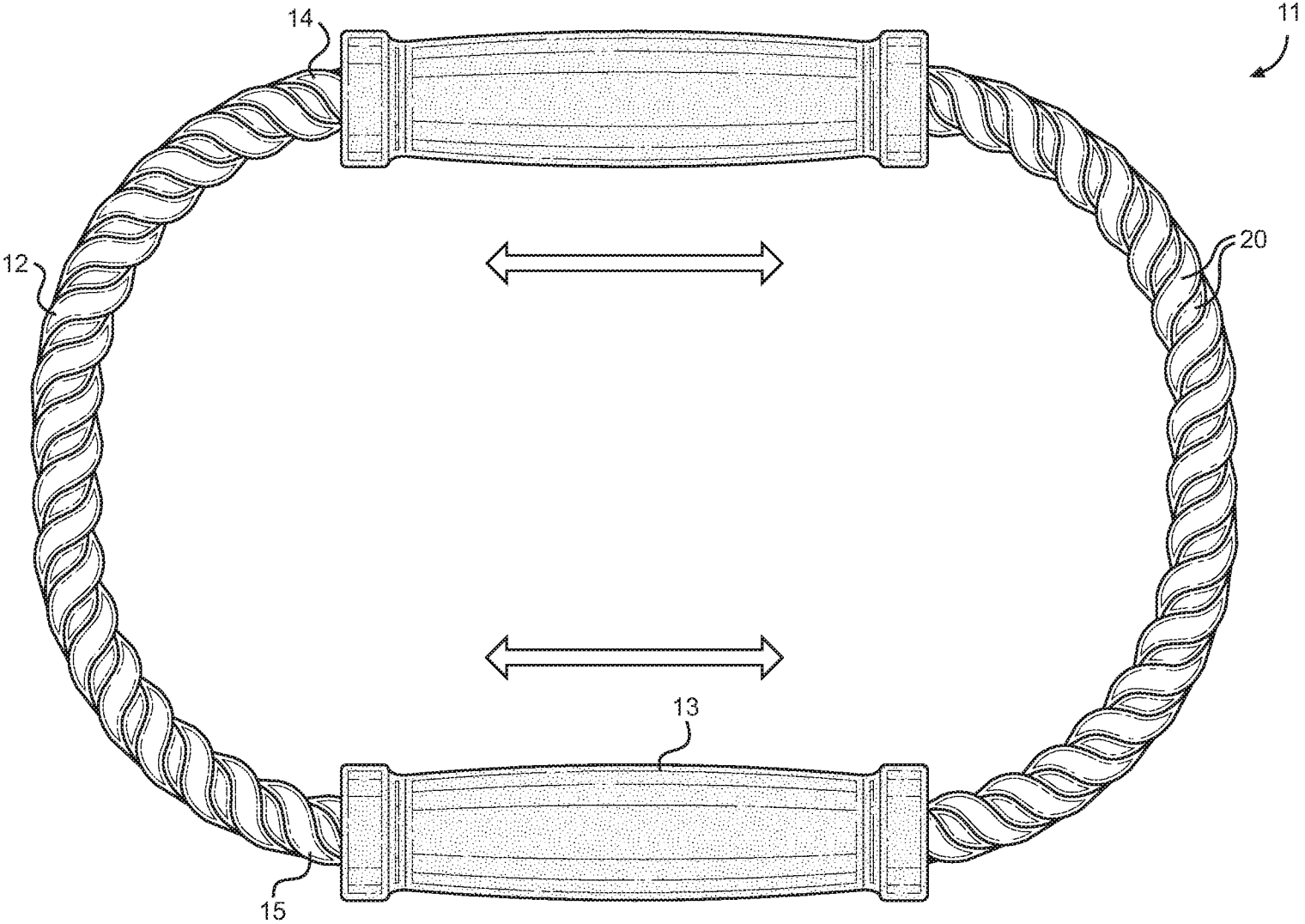
FIG. 1 shows a perspective view of an embodiment of the exercise ring.

Reference is made herein to the attached drawings. Like reference numerals are used throughout the drawings to depict like or similar elements of the exercise ring. The figures are intended for representative purposes only and should not be considered to be limiting in any respect.

Referring now to FIG. 1, there is shown a perspective view of an embodiment of the exercise ring. The exercise ring 11 comprises a single continuous closed ring 12, wherein the ring 12 comprises a flexible and inelastic material, such as, but not limited to nylon or cotton. In this way, the ring 12 can deform when forces are applied thereto, while still providing a constant resistance to a user through the application of said forces. This constant resistance allows a user to counteract the forces applied to the ring, engaging various muscle groups in order to increase strength and develop muscle growth. In the illustrated embodiment, the ring 12 comprises a plurality of strands 20 disposed in a braided pattern across the length of the ring 12. The braided pattern provides increased strength and structural integrity to the ring 12, while also allowing the ring 12 to deform as gaps are created between the plurality of strands 20 when forces are applied thereto.

The ring 12 further comprises a plurality of handles 13 disposed therealong. The plurality of handles 13 are configured to provide a user with an ergonomic and comfortable gripping surface. In the illustrated embodiment, the plurality of handles 13 are disposed on a first side 14 of the ring 12 and a second side 15 of the ring 12, such that a pair of users can grip the ring 12 via the handles 13 to provide opposing resistance forces during exercise. In some embodiments, the plurality of handles 13 are integral to the ring 12, such that the handles 13 do not shift along the ring 12 when in use, whereas in the illustrated embodiment, the plurality of handles 13 are slidably engaged with the ring 12. In this way, the plurality of handles 13 can be positioned as desired by the user to complement the desired exercise. In the illustrated embodiment, the plurality of handles 13 are disposed equiangularly about the ring 12, such that forces applied to at least one of the plurality of handles 13 are directly opposed by at least one of the opposing plurality of handles 13.

Figure 2:
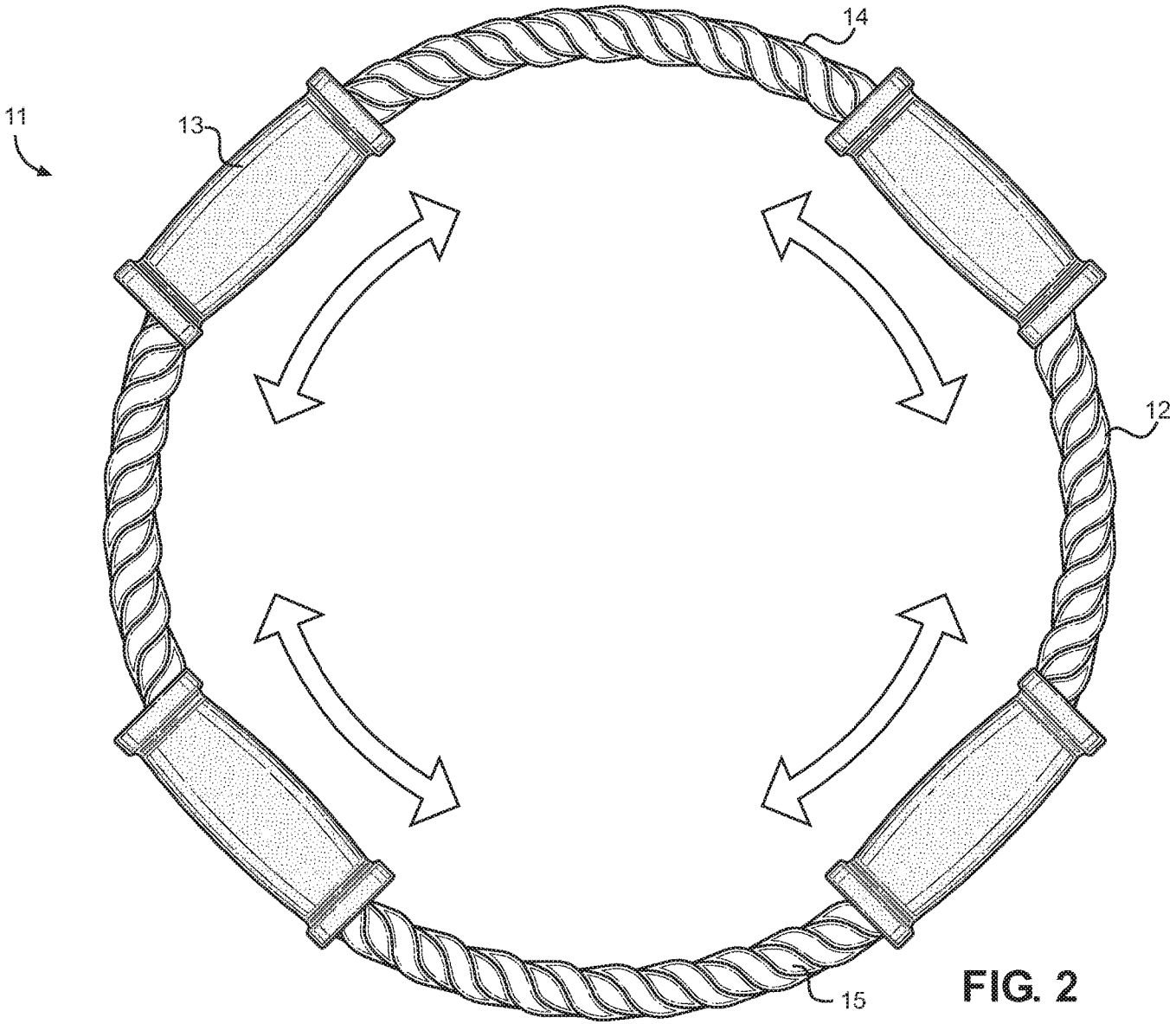
FIG. 2 shows a perspective view of an alternate embodiment of the exercise ring.

Referring now to FIG. 2, there is shown a perspective view of an alternate embodiment of the exercise ring. In the illustrated embodiment, the exercise ring 11 comprises a plurality of handles 13, wherein each of the plurality of handles 13 is disposed equiangularly along the ring 12. The positioning of the handles shown in the illustrated embodiment allow a plurality of users to simultaneously utilize the exercise ring 11, such that each user can resist forces applied to the ring 12 along multiple simultaneous vectors, increasing the number of muscle groups a user must engage to counteract the forces applied to the ring 12. Alternatively, a pair of users can grip a pair of the plurality of handles 13, such that the pair of users can impose varying degrees of force along multiple vectors, in order to provide a user with a dynamic range of forces to counteract, thereby engaging more muscle groups.

In one exemplary use, the user grips one of the plurality of handles 13 and removably secures the ring 12 to a support. In some embodiments, the support comprises another user gripping an opposing handle 13, whereas in an alternate embodiment, the support comprises a vertical support member inserted through a center of the ring 12, such as a foot of the user, a post, or the like. The user then pulls the handle 13 away from the support until the pulling force generates resistance in the ring 12. The user then holds the pulling forces for a set amount of time to engage various muscle groups over a period of time, before relaxing. The pulling and holding steps are then repeated for a desired number of repetitions in order to maximize muscle development and encourage muscle growth. In some embodiments, the user alternates with the second user between repetitions, such that one user pulls against a second user for a first repetition, and a second user pulls against the resistive forces of the first user for a second repetition, and so on, until each user repeats a desired number of repetitions. This alternating method allows a first user to engage muscle groups associated with pulling during the first repetition, and muscle groups associated with resisting forces during the second repetition, such that the muscles are given an appropriate resting period between repetitions. In this way, the user is assured maximal muscle development across a greater number of muscle groups.

Figure 3:
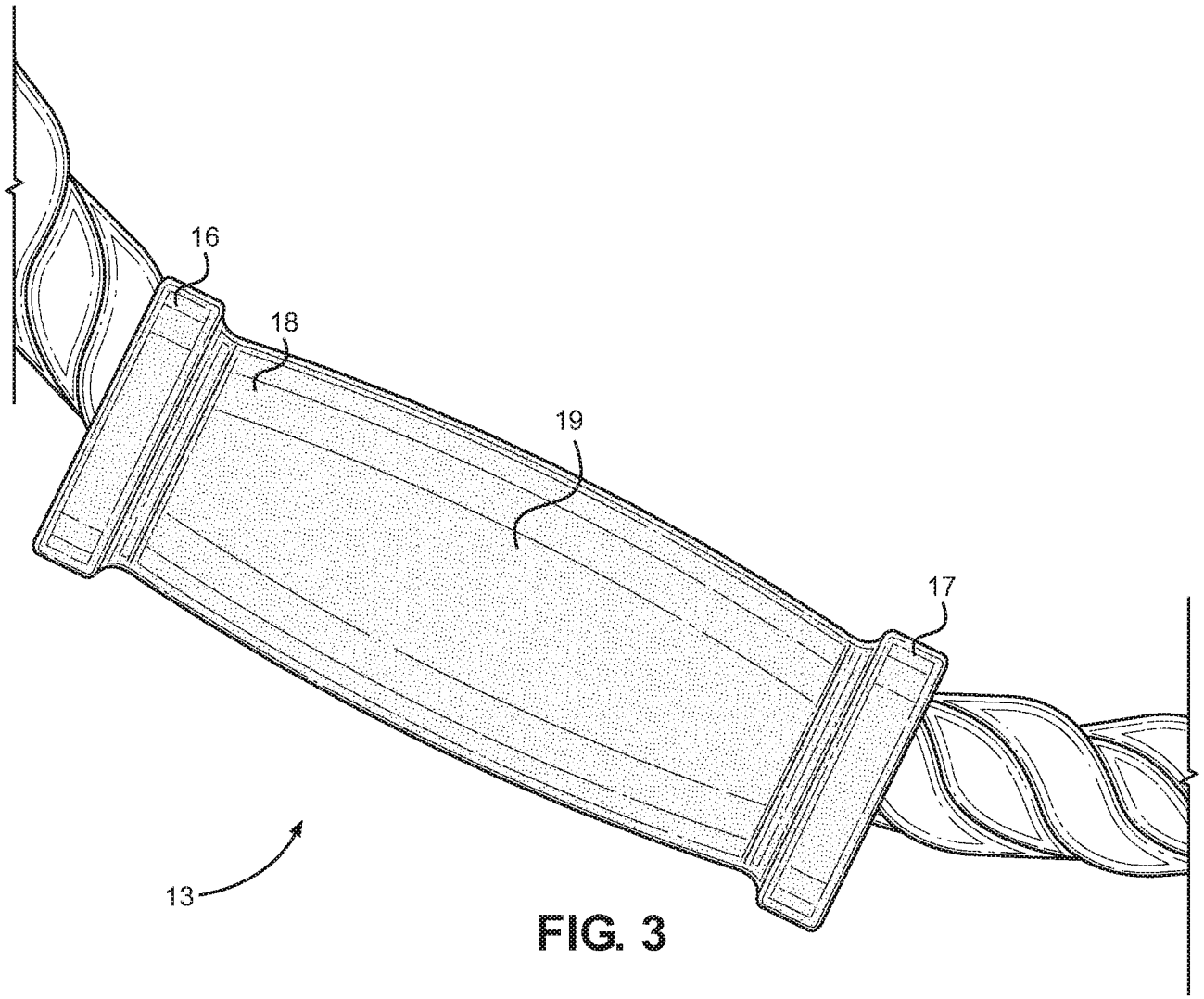
FIG. 3 shows a close-up view of the handle of an embodiment of the exercise ring.

Referring now to FIG. 3, there is shown a close-up view of the handle of an embodiment of the exercise ring. In the illustrated embodiment, the plurality of handles 13 comprise a cylindrical body 18 having a first end 16 and a second end 17. In the shown embodiment, the first and second ends 16, 17 comprise a diameter greater than that of the cylindrical body 18, such that a hand of the user does not slide off of the handle 13 during use, and is instead constrained by the first and second ends 16, 17. The user grips the cylindrical body 18 such that a center portion 19 of the cylindrical body 18 is positioned in a middle of the hand. In the illustrated embodiment, the center portion 19 comprises a diameter greater than the cylindrical body 18, wherein the center portion 19 tapers towards the first and second ends 16, 17, thereby providing an ergonomic grip for the user. In an alternate embodiment, the handle 13 can comprise a plurality of finger grooves therein, each configured to receive a finger of the user therein, such that the user's grip is maintained along a desired position of the handle 13. In some embodiments, the handle 13 comprises a material having a coefficient of friction greater than one, such that the user's hand does not slide along the handle during use. Furthermore, in an alternate embodiment, the handle 13 comprises a pliable cushioned material, such as gel or foam, such that the handle 13 provides a comfortable gripping surface for the user.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise ring, comprising:

a continuous permanently closed ring comprising a flexible, inelastic material;

wherein the ring comprises a plurality of strands in a braid;

a plurality of handles disposed on opposing sides of the ring;

wherein the ring extends through a longitudinal axis of each of the plurality of handles;

wherein the plurality of handles respectively comprise a generally cylindrical body having a first end, a second end, and a center portion;

wherein the plurality of handles are configured to provide an ergonomic gripping surface.

2. The exercise ring of claim 1, wherein the plurality of handles are slidably engaged with the ring.

3. The exercise ring of claim 1, wherein the plurality of handles are disposed equiangularly about the ring.

4. The exercise ring of claim 1, wherein the first end and the second end each have a larger diameter than opposing ends of the center portion, respectively.

5. The exercise ring of claim 1, wherein a centermost region of the center portion comprises a diameter greater than that of opposing ends of the center portion.

6. The exercise ring of claim 5, wherein the diameter of the centermost region of the center portion tapers towards the first end and the second end.

7. The exercise ring of claim 1, wherein the plurality of handles comprise a pliable material.

8. The exercise ring of claim 1, wherein the plurality of handles comprise a material having a coefficient of friction greater than one.

9. An exercise ring, consisting of:

a permanently closed ring consisting of a flexible, inelastic material;

a plurality of handles disposed on opposing sides of the ring;

wherein the ring extends through a longitudinal axis of each of the plurality of handles;

wherein the plurality of handles respectively consist of a cylindrical body having a first end, a second end, and a center portion;

wherein the plurality of handles are configured to provide a gripping surface.

* * * * *